United States Patent [19]

White

[11] Patent Number: 5,076,651

[45] Date of Patent: Dec. 31, 1991

[54] GOLF BAG STORAGE RACK

[75] Inventor: Daryl White, Laguna Beach, Calif.

[73] Assignee: Variety International Inc., Irvine, Calif.

[21] Appl. No.: 562,791

[22] Filed: Aug. 6, 1990

[51] Int. Cl.[5] ..... A47B 43/00

[52] U.S. Cl. ..... 312/265.3; 211/4; 312/328

[58] Field of Search ..... 211/70.2, 4; 312/265.1, 312/265.4, 265.3, 265.2, 257.1, 327, 328

[56] References Cited

U.S. PATENT DOCUMENTS

| | | | |
|---|---|---|---|
| 158,226 | 12/1924 | Tufts | 312/328 |
| 2,749,199 | 6/1956 | O'Connor | 312/257.1 |
| 3,215,181 | 11/1965 | Reed | 211/70.2 |
| 3,734,033 | 5/1973 | Downing | 312/257.1 |
| 4,235,493 | 11/1980 | Bridges et al. | 312/265.3 |
| 4,265,501 | 5/1981 | Halliburton | 312/265.6 X |
| 4,632,473 | 12/1986 | Smith | 312/265.1 |

*Primary Examiner*—Joseph Falk

*Attorney, Agent, or Firm*—G. Donald Weber, Jr.

[57] ABSTRACT

A storage rack particularly suited for the secure temporary deposit of golf bags or other large and/or cumbersome items. The rack includes one or more cages or compartments with a moveable lid or cover at the top thereof. In addition to closing the upper portion of the cage, the lid includes a coin-operated locking mechanism. The locking mechanism includes a key which is obtained by inserting coins therein. At a minimum, the lid and cage sufficiently restrain a golf bag to prevent the bag and/or the contents thereof, especially the golf clubs, from being removed except by the holder of the key. Additional enclosing walls, bars or platforms can be selectively added to the cage for additional security.

15 Claims, 3 Drawing Sheets

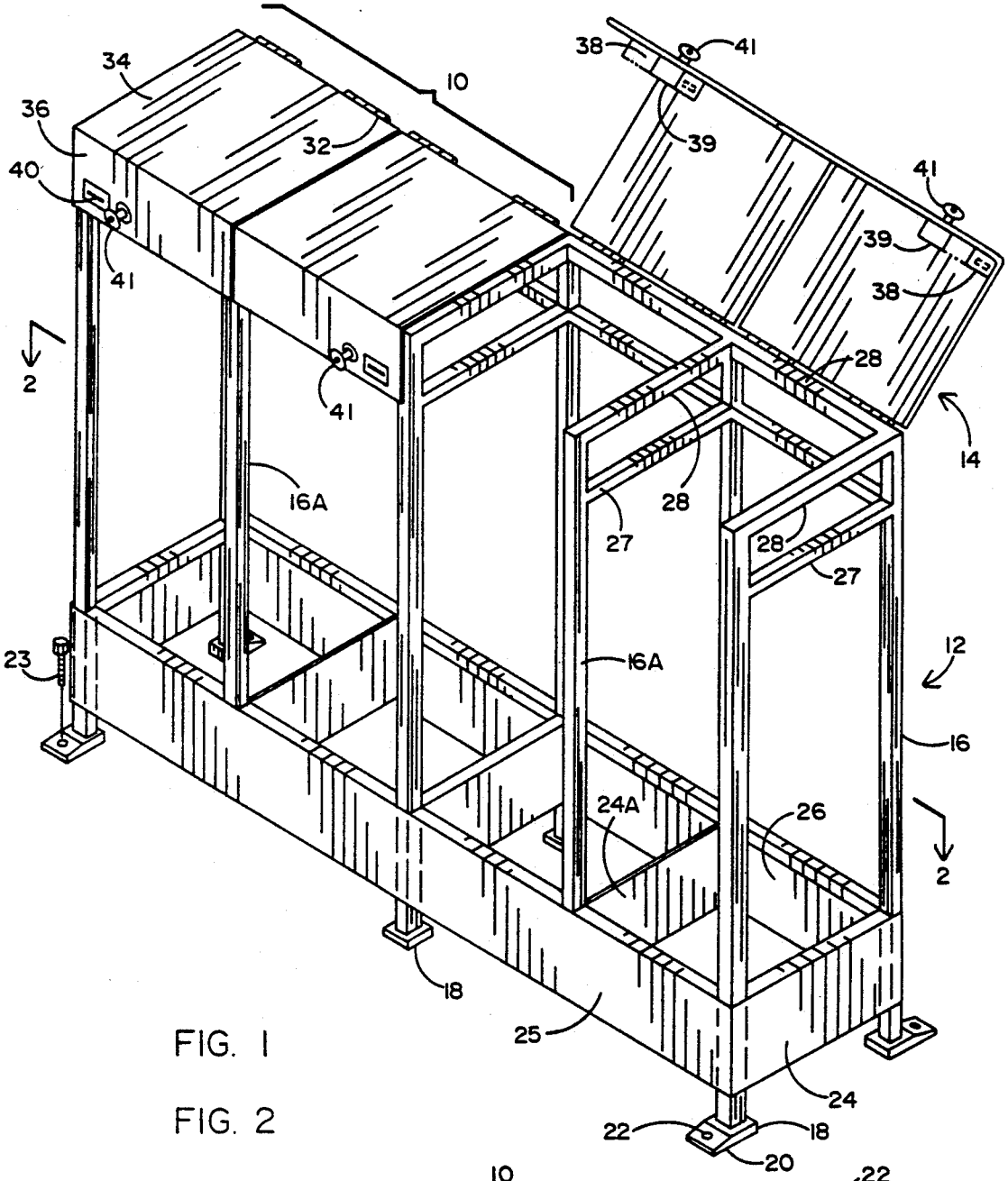
FIG. 1
FIG. 2
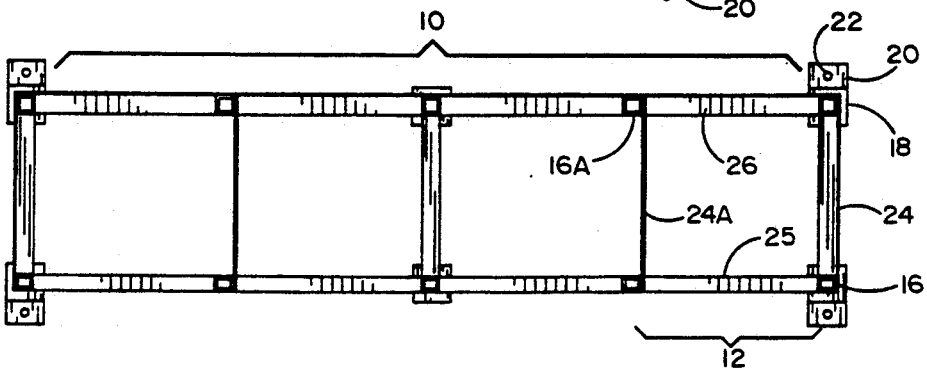

GOLF BAG STORAGE RACK

BACKGROUND

1. Field of the Invention

This invention relates, generally, to a storage rack for golf bags. More specifically, the invention provides a storage rack to conveniently and securely deposit golf bags on a temporary basis at public, semi-private and private golfing facilities when no other form of secure storage is available.

2. Prior Art

It is well-known that golf is a rapidly growing sport or recreation throughout the world. The growth is especially noticed in the United States and Japan. Because of this growth the crowds at golf courses are increasing. This is especially the case at public or semi-private golf courses. At such courses, the players tend to carry their own golf bags to some central, designated drop-off location, for example, near the pro shop, the starter's office or the like. Consequently, many unattended golf bags tend to accumulate in a relatively unguarded, unsecure area.

Heretofore, whenever golfers needed to go inside the clubhouse, to the pro shop, the restaurant and the like, they would need to leave their golf bag and its contents outside and often unattended, risking the loss of individual clubs or complete sets of clubs including bags due to theft. Due to the increased popularity of more exotic and expensive materials being used in the construction of golf clubs, the value or cost of golf club sets has risen markedly in recent years leading to an increase in the theft of golf clubs.

Likewise, a golfer may take selected clubs to the driving range, to the putting green or the like without the bag and its contents. Again, unless the golfer can arrange to have his bag and remaining clubs attended while practicing, he runs the risk of the loss of his golf bag and/or its contents by simply leaving the bag outside the clubhouse, pro shop and other such places.

In addition to the possible loss of the golf bag and/or its contents, the bag and its contents are in peril from falling over or other damage as it is balanced against a wall, laid on the floor, or similarly deposited. Although some golf facilities have stands, somewhat on the order of bike racks, which provide a space into which a bag may be leaned, these racks provide no security against theft, vandalism or the like.

In the very nicest golf facilities, usually at private golf courses, it is possible for members and guests of that facility to "check" a golf bag at a room specifically provided for that purpose. This secure storage is available to the member until the next time he chooses to play at the course and has little applicability to the need for temporary external (outside) storage to which this product is addressed.

Golfers who drive vehicles to the golf facility may use their vehicles as check rooms. However, this means carrying the golf bag back and forth from a vehicle which may be parked a considerable distance from the club house, pro shop or the like. Storage of the bag in the vehicle is reasonably safe, but very inconvenient.

The invention herein provides a means to avoid the inconvenient burden of carrying the golf bag everywhere that one goes while at the golf facility, as well as the lack of security when the owner must leave the bag unattended in a heavily trafficked area. The invention herein offers a convenient and reasonably safe means to store golf bags as well as other large or bulky items when these owners need to be out of visual range of the item. Furthermore, the invention is considerably less costly than a separate room and the salary (or gratuity) of an employee retained to check bags.

PRIOR ART STATEMENT

Applicant has made no formal search of the prior art but is unaware of any related products.

SUMMARY OF THE INSTANT INVENTION

The storage rack of the instant invention includes a generally rectilinear cage or compartment of sufficient size to accomodate a golf bag or the like. Typically, the cage has a supporting pillar at each corner with one or more cross bars or plates to retain the stored item. At the bottom of each pillar, an enlarged base plate may be present for greater stability.

A lid is pivotally mounted at the top of the cage, usually overlapping a portion of the front of the cage. This frontal portion, as well as the top of the lid, completes the necessary restraint for the stored items. Additional enclosure parts may be used such as a floor, walls, and the like. A locking mechanism for selectively securing the lid to the cage provides controlled security. Typically, the locking mechanism includes a coin box or other selectively activated lock system which is provided for use when the rack is rented.

BRIEF DESCRIPTION OF THE DRAWINGS

FIG. 1 is an isometric view of one embodiment of the instant invention showing a plurality of cages with some lids open and other lids closed.

FIG. 2 is a cross-sectional view of the invention taken along the lines 2—2 in FIG. 1.

DESCRIPTION OF PREFERRED EMBODIMENTS

Figure 4:
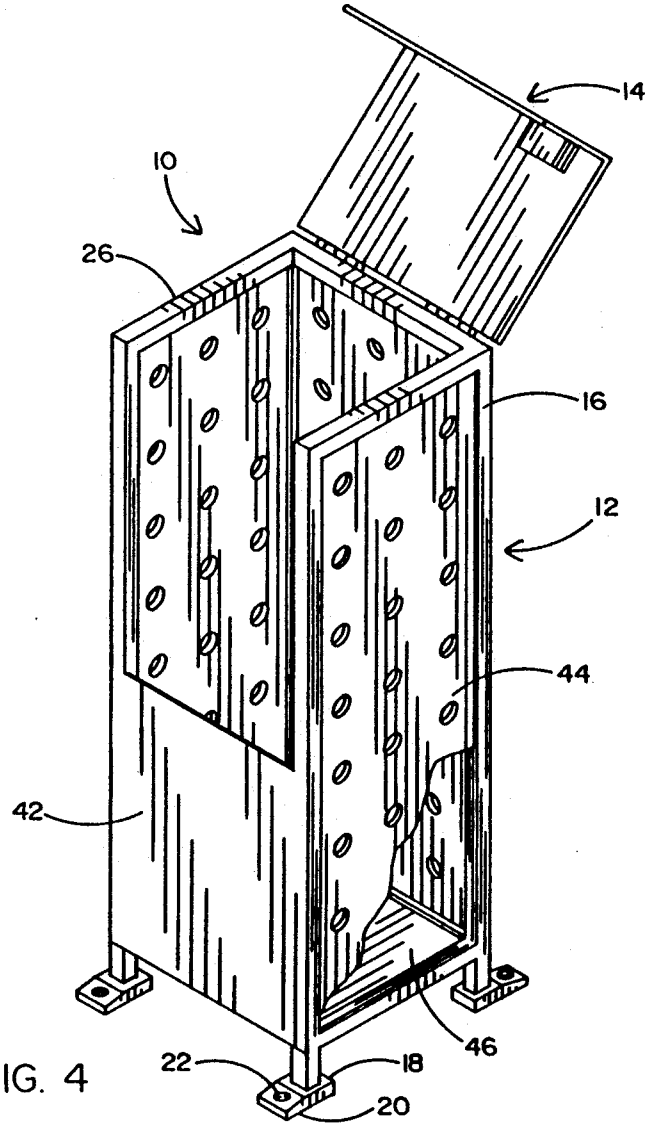
FIG. 4 is a partially broken away, isometric view of another embodiment of the invention.

Referring now to FIG. 1, there is shown an isometric view of one embodiment of the instant invention. Typically, the invention is used to temporarily store golf bags.

In this embodiment, the storage rack 10 of the instant invention is composed of a plurality of cages 12. However, the invention contemplates the use of one or more such cages. Each cage includes a separate lid 14 which is hingedly mounted at the top of the cage 12. A portion of the lid 14 overlaps the upper front portion of the cage 12. Of course, the storage rack 10 may consist of one or more cages 12 or any multiple thereof, as desired.

In this embodiment, cage 12 is rectilinear, but may be of any suitable shape such as cylindrical, pentagonal, and the like. At least one support stanchion 16 is provided for each cage. Typically, a stanchion 16 is positioned at each corner of the rectilinear cage 12. In addition, intermediate stanchions 16A can be used for support between adjacent cages. The stanchions 16 and 16A provide strength and stability for the cage 12. A base plate 18 is provided at the bottom of selected stanchions 16 to provide additional stability for the storage rack 10. Base plate extensions 20 are formed at selected base plates 18. The base plate extensions 20 include at least one aperture 22 therethrough. Thus, a suitable fastener 23 such as a bolt, screw, rivet or the like, can be selectively passed through the aperture 22 in the base plate extension 20 to secure the rack 10 to the floor or ground. The fastener 23 provides further stability and security to the storage rack 10. Of course, the base plate extension 20 and fastener 23 are merely representative of one possible means to secure and increase stability for the storage rack 10. Normally, the storage rack 10 is constructed to be free-standing and does not require further stabilization than that provided by the base plates 18. Furthermore, security for the entire rack 10 is optional or may be achieved by a number of other suitable means when desired by the user. For example, the entire rack may be connected to a wall by means of an L-bracket which extends from the top or sides of the rack.

Side, front and back plates 24, 25 and 26, respectively are joined to the stanchions 16 near the bottom of cage 12. The plates 24, 25 and 26 can be joined to the stanchions by welds, rivets, bolts or the like. In some instances, the plates 24, 25 and 26 can be integrally formed with the stanchions 16. As shown in the embodiment in FIG. 1, top bars 28 join the stanchions 16 to form three top ends at the top of cage 12. In addition, intermediate cross bars 27 are joined to the stanchions 16 to form at least three sides of the cage 12. The cross bars 27 are, typically, spaced from and parallel to the top bars 27. Of course, the cross bars 27 can take any suitable position and/or configuration in the cage 12. The cross bars 27 and the plates 24, 25 and 26 are positioned so that the stored article, i.e. a golf bag 30, may not fit therebetween.

A lid 14 is pivotally mounted at the top of the cage 12. A hinge 32, or a series of hinges, permits the lid 14 to be raised above cage 12 in an "open" position and lowered onto the cage 12 in the "closed" position.

In a preferred embodiment, the lid 14 is L-shaped having a top 34 and a front plate 36. A coin-operated locking mechanism 38 is mounted on the inside surface of front plate 36 of lid 14. The locking mechanism 38 selectively secures the lid 14 to the cage 12 in the closed position. That is, a key operated hasp selectively engages a portion of a stanchion 16 whereby the lid 14 is in locked engagement. A coin slot 40 in front plate 16 communicates with the necessary coin collection box 39 which is also placed on the inside surface of front plate 36 as a common means for renting the storage rack 10. The collection box 39 may be welded, integrally formed, or otherwise securely mounted to the back or inner surface of the front plate 36. The coin slot 40 is positioned such that coins, tokens or the like inserted therein will be retained by the collection box.

Upon insertion of the appropriate coins or tokens, a key 41 can be removed from the locking mechanism 38. Thus, the golf bag is placed in a cage 12 in rack 10, the lid 14 is closed, the coins placed in collection box 39 via slot 40 and the key 41 removed by the user. Upon reinsertion of key 41, the locking mechanism can be opened and access can be obtained to the interior of cage 12 by the proper user.

Of course, alternative methods for renting the storage racks may be used and are available such as obtaining a key from a concessionaire, or the like. The method described and shown herein is similar to that used frequently on ski or transportation terminal lockers.

Referring now to FIG. 2, there is shown a cross-sectional view of the rack 10 taken along the lines 2—2 in FIG. 1. Again, the rack 10 shown in this embodiment includes a plurality of individual cages or compartments 12. The compartments are defined by the stanchions 16, the side, front and back plates 24, 25 and 26, respectively. In addition, an intermediate side panel 24A is interposed between the front and rear panels 25 and 26 and, preferrably, attached to stanchions 16A. The intermediate side panel 24A is generally formed of the same material as the other sheets but, in this case, may be formed without an upper or lower lip (or rolled edge) inasmuch as the structural strength needed for the construction of rack 10 is not as necessary in producing the panels 24A.

The bases 18 at the ends of stanchions 16, the extensions 20 from the bases 18 and the apertures 22 through the extensions are also depicted.

Figure 3:
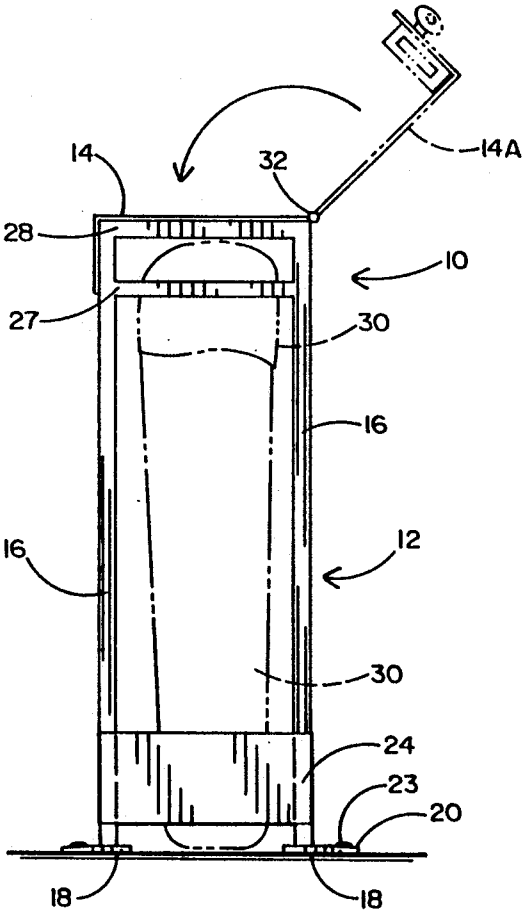
FIG. 3 is side view of the embodiment shown in FIG. 1.

Referring now to FIG. 3, there is shown a side view of the rack 10 enclosing golf bag 30 which is shown schematically in dashed outline. In this instance, the rack 10 includes the stanchions 16 which are joined to the bases 18 and attached to a ground or support surface by means of fastener 23 which passes through the aperture in the base extension 20.

An intermediate side bar 27 is provided between the stanchions 16 adjacent the top ends thereof. Side bar 27 retains the upper portion of the golf bag 30 in the cage 12.

A lid 14 is hingedly joined to the rack 10 by hinges 32 and rests upon the upper bar 28. The front lip of the lid 14 overlies the front of the cage 12 and is selectively secured thereto in the closed and locked position. As shown in FIG. 3, the closed lid 14 (solid line) is deemed to be locked and the key removed.

In the open position or unlocked condition, the lid 14A (shown in dashed outline) is also hingedly connected to the frame of rack 10 by hinge 32. As shown in FIG. 3, the locking mechanism 38 with a locking hasp is shown in side view. The key 41 is inserted into the locking mechanism 38 and can be removed when coins or tokens are inserted to slot 40 (see FIG. 1).

Referring now to FIG. 4, there is shown an isometric, partially cut away, view of another embodiment of the instant invention. In this embodiment, the storage rack 10 includes a cage 12 and the pivotally mounted lid 14 similar to that seen in FIGS. 1 through 3. The cage 12 includes the stanchions 16, base plates 18, base plate extensions 20 and top bars 28, as described in FIGS. 1 through 3. However, in this embodiment, a face plate 42 encloses at least a portion of the front of cage 12. Typically, face plate 42 covers approximately the lower third of the front side of the cage 12. The size and location of face plate 42 is determined by several factors. For example, in golf bag storage, large articles must be lifted over face plate 42 into cage 12 proper. The other sides of cage 12 can be completely enclosed with a perforated siding 44. Of course, the face plate 42 and/or the siding can be a solid, a grid, a mesh or the like.

In this embodiment, a floor 46 is included at the bottom of cage 12. Although the floor 46 is shown in FIG. 4, such a feature can be added to the embodiment seen in FIGS. 1 through 3.

Figure 5:
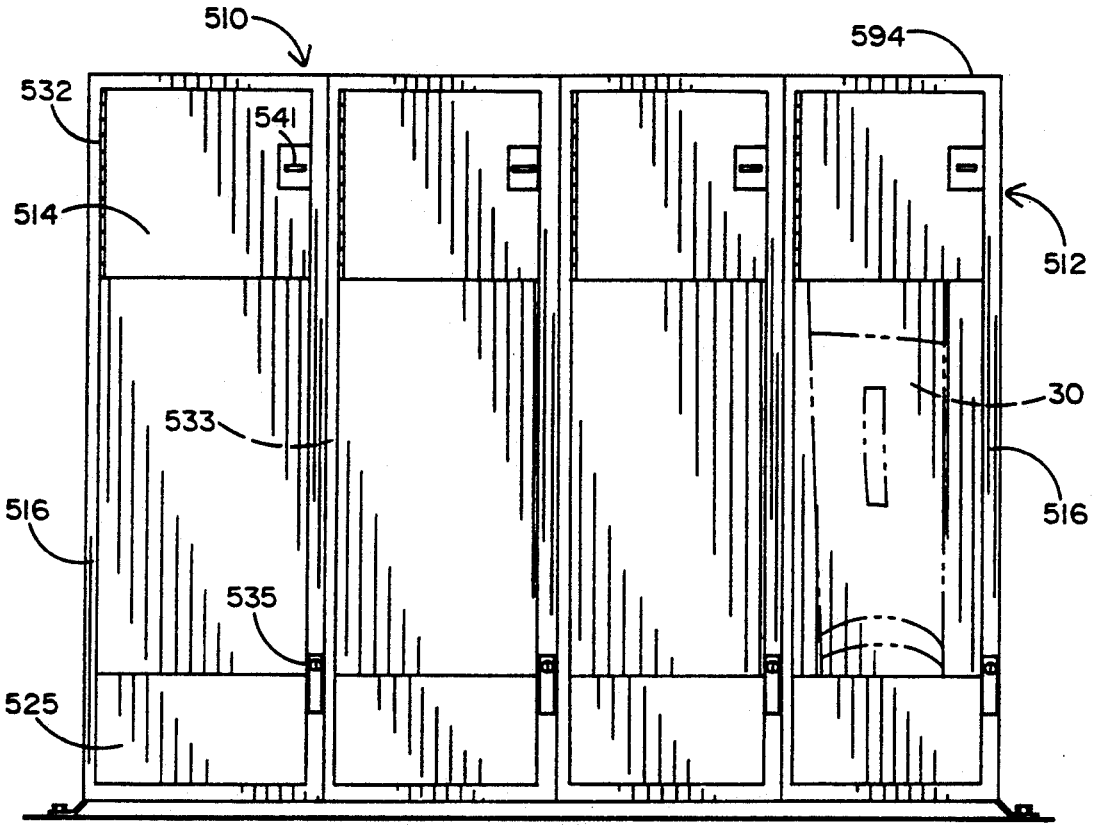
FIG. 5 is a front view of another embodiment of the invention.

Referring now to FIG. 5, there is shown a front view of an alternative embodiment of the instant invention. In this embodiment, a rack 10 is comprised of multiple cages 512. In this embodiment, each cage 512 includes three panels which are substantially planar and continuous. These panels form the two sides and back of the compartment. The sides can be joined together by stanchions 516 or can be independently formed by bending and/or rolling of corners and edges to obtain the appropriate structural strength. The front of the compartment includes a bottom panel 525 which protects and retains the bottom portion of the golf bag 30 (shown in dashed outline) which is stored in the compartment 512. The top of the cage is a rigidly fixed top panel 594 which joined to or integrally formed with at least one of the side panels. The upper portion of the cage includes an upper panel 514 which is hingedly mounted to one of the side of the cage 512. The upper panel 514 is free to pivot or swing around the vertical axis of the hinge 532.

The upper panel 514 also includes a locking mechanism on the inside thereof which is associated with a coin collecting box in a similar fashion to that shown and described relative to FIG. 1 above. Again, the upper panel includes a coin slot 540 which is associated with the locking mechanism and selectively releases the key 541 which is associated with the locking mechanism.

While it is suggested that the locking mechanism is formed and joined to the inner surface of the door, it is, of course, contemplated that the locking mechanism and/or the coin collection mechanism can be mounted in the side wall or in a stanchion 516 so long as the locking mechanism is selectively operable in response to the insertion of coins therein. For example, a hollow tube 533 can be used as or in place of a stanchion 516. The hollow tube can be used to collect coins from the locking mechanism. The coins can be retrieved from this collection box via a locked door or panel 535.

Figure 6:
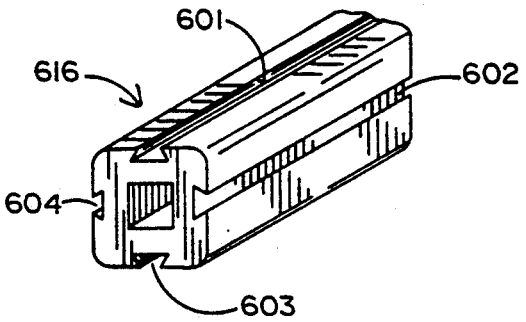
FIG. 6 is an isometric, partially broken away, view of one stanchion or pillar used with one embodiment of the instant invention.

Referring now to FIG. 6, there is shown a portion of a representative stanchion 616 which can be used in one or more embodiments of the instant invention. In this instance, the stanchion 616 is an elongated rod or tube which includes a plurality of slots or grooves 601, 602, 603 and 604 around the periphery thereof. In the embodiment shown in FIG. 6, the stanchion 616 is a hollow tubular arrangement which is, generally, rectilinear in cross-section. The grooves provided around the periphery thereof have sloping inner surfaces which are adapted to receive, engage and interlock with mating ends of side walls, side plates, or the like, in order to produce and provide an interlocking relationship between the stanchion and the side plates. Of course, other configurations of the stanchions and/or the grooves are contemplated and can be utilized in other embodiments of the invention.

Figure 7:
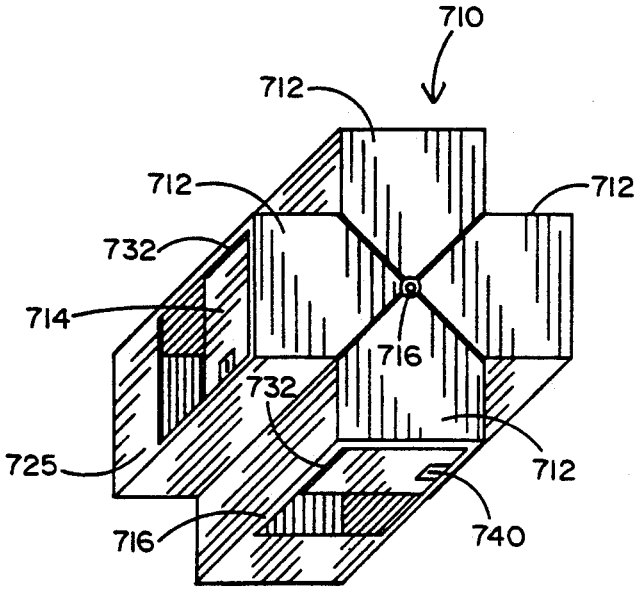
FIG. 7 is a partially broken away, perspective view of another arrangement of the instant invention.

Referring now to FIG. 7, there is shown an alternative arrangement of the rack of the instant invention. In this case, the rack 710 is formed of a plurality of individual compartments or cages 712 which are joined together at a common point. The individual components have a generally rhombic or pentagonal configuration and are joined at a common, central location 716. Typically, this joinder is effected by means of a suitable stanchion such as shown in FIG. 6. In particular, the joinder is effected at the apex of the respective cages.

This arrangement is useful in instances where the rack can be free-standing and uses a somewhat smaller floor space. In these arrangements, the compartments 712 are formed in much the same manner as the compartments of any of the other embodiments described above including stanchions, side panels, front panels, lids and/or front covers or the like.

The storage racks shown are, typically, manufactured of alloy steel for strength and durability. Likewise, the lid or any of the panels can be of perforated material, grating, or the like. Many other suitable materials may be used in the manufacturing of the rack. Grouping of the cages in rows of four, in back-to-back or other arrangements may reduce manufacturing costs because of the shared sides and backs. Of course, single cages can also be produced. For example, a generally cylindrically-shaped cage can be suspended from a single stanchion which is embedded in concrete or the like.

Thus, there is shown and described a preferred embodiment of a storage rack. The particular configuration shown and described herein relates to a storage of golf bags. While this description is directed to a particular embodiment, it is understood that those skilled in the art may conceive modifications and/or variations to the specific embodiments shown and described herein. For example, the cage 12 can take the form of a cylinder supported by an appropriate stanchion 16. Any such modifications or variations which fall within the purview of this description are intended to be included therein, as well. It is understood that the description herein is intended to be illustrative only and is not intended to be limitative. Rather, the scope of the invention described herein is limited only by the claims appended hereto.

I claim:

1. A storage device comprising, first, second, third and fourth stanchions each having an upper and lower end;

first plate means joining said first and said second stanchions adjacent said lower end;

second plate means joining said second and said third stanchions adjacent said lower end;

third plate means joining said third and said fourth stanchions near said lower end;

fourth plate means joining said fourth and said first stanchions adjacent said lower end;

first attachment means joining said first and said second stanchions adjacent said upper end;

second attachment means joining said second and said third stanchions adjacent said upper end;

third attachment means joining said third and said fourth stanchions adjacent said upper end;

top bar means mounted to said upper end of said second and said third stanchions; and lid means pivotally mounted adjacent said top bar;

said lid having a first portion which encloses an area defined by said upper ends of said stanchions, said lid means having a second portion perpendicularly joined to said first portion and enclosing an area between said upper ends of said first and fourth stanchions.

2. The device recited in claim 1 further comprising, at least second and third top bars, said second top bar mounted across said upper ends of said first and said second stanchions, and said third top bar mounted across said upper ends of said third and said fourth stanchions.

3. The device recited in claim 2 including, a locking mechanism mounted at said second portion of said lid means.

4. The device recited in claim 1 including, a money collecting device mounted at said lid means.

5. The device recited in claim 1 wherein, a plurality of storage devices are joined into a single unit.

6. The device recited in claim 1 wherein, each of said attachment means is a bar.

7. The device recited in claim 1 wherein, at least one of said attachment means is a perforated wall.

8. The device recited in claim 1 wherein, said lid means is composed of sheet metal.

9. The device recited in claim 1 wherein, each of said first, second, third and fourth stanchions each has a bottom end; and a separate base plate mounted at the bottom end of each said stanchions.

10. The device recited in claim 1 wherein, each said base plate has a fastener which extends therethrough for securing the device in place.

11. The device recited in claim 1 wherein, said stanchions, said attachments, said plates, said top bar, and said lid are all composed of alloy steel.

12. A storage unit comprising, vertical support means, first enclosure means disposed adjacent one end of said vertical support means, second enclosure means disposed adjacent another end of said vertical support means, at least one of said first and second enclosure means including at least a portion thereof movably mounted relative to said vertical support means, and coin operated locking means mounted on said one enclosure means to selectively prevent movement of said portion thereof.

13. The unit recited in claim 12 wherein, said vertical support means includes at least one vertical stanchion means.

14. The unit recited in claim 12 wherein, said vertical support means includes grooves therein for attachment of said first and second enclosure means.

15. The unit recited in claim 12 wherein, said vertical support means comprises a single stanchion, said first enclosure means includes a plurality of individual cages, and said second enclosure means includes a plurality of individual cages.

* * * * *